United States Patent [19]

Graser

[11] 4,043,095

[45] Aug. 23, 1977

[54] METHOD OF PACKAGING IN CARRIER WITH DROP DOWN PARTITION

[75] Inventor: Earl J. Graser, Monroe, La.

[73] Assignee: Olinkraft, Inc., West Monroe, La.

[21] Appl. No.: 661,909

[22] Filed: Feb. 27, 1976

Related U.S. Application Data

[62] Division of Ser. No. 510,681, Sept. 30, 1974, Pat. No. 3,974,911.

[51] Int. Cl.[2] ..... B65B 5/06; B65B 21/14

[52] U.S. Cl. ..... 53/26; 53/29; 53/37

[58] Field of Search ..... 53/26, 29, 37, 48, 186, 53/251, 252, 284, 35

[56] References Cited

U.S. PATENT DOCUMENTS

| | | | |
|---|---|---|---|
| 2,961,811 | 11/1960 | Norwood | 53/37 |
| 3,300,947 | 1/1967 | Fahrenbach | 53/186 |
| 3,778,959 | 12/1973 | Langen et al. | 53/26 |

*Primary Examiner*—Robert Louis Spruill
*Attorney, Agent, or Firm*—O'Brien & Marks

[57] ABSTRACT

Two separate groups of six articles are assembled in separate lines while a carrier is unfolded, the carrier having a partition joined with a hinge to a top panel thereof such that the partition drops under the force of gravity to a vertically extending position. Then the groups of articles are assembled into opposite ends of the carrier on opposite sides of the partition whereby the partition maintains the groups separated.

2 Claims, 7 Drawing Figures

METHOD OF PACKAGING IN CARRIER WITH DROP DOWN PARTITION

CROSS REFERENCE TO RELATED APPLICATION

This is a divisional application of copending application Ser. No. 510,681 filed Sept. 30, 1974, now U.S. Pat. No. 3,974,911.

BACKGROUND OF THE INVENTION

1. Field of the Invention

The invention relates methods of assemblying fragile articles such as twelve bottles in to carriers or cartons made from fiberboard or the like for storage, handling and the like.

2. Description of the Prior Art

The prior art, as examplified in U.S. Pat. Nos. 2,684,178, 2,830,726, 3,394,800 and 3,554,402, contains a number of carriers having partitions between articles therein. Several prior carriers have partitions which are folded down from one of a pair of top panels to extend between articles within the carrier; however, such prior art partitions require a separate step of folding the partition downward and sometimes securing the partition during the assembly of articles within the carrier.

SUMMARY OF THE INVENTION

The invention is summarized in a method of assembling a pair of separate groups of fragile articles into a carrier comprising the steps of arranging the pair of groups in separate assembly lines, unfolding a carrier blank from a flat condition to an open condition, the carrier blank having an inside partition hinged to an inside top panel such that when the carrier is opened from a flat condition the partition drops into a position extending sufficiently vertically to from separated portions within the carrier, inserting the groups of articles into respective opposite ends of the open carrier into the separated portions thereof, and closing the open ends of the carrier to secure the articles in the carrier.

An object of the invention is to provide a simplified and reliable process of packaging twelve fragile articles such as bottles in a carrier.

Another object of the invention is to utilize a carrier with a partition which automatically drops down into position when the carrier body is folded open to form a divider therein.

An advantage of the invention is that the utilization of a partition which automatically pivots down into a vertical position when a carrier is unfolded eliminates the requirement for machinery and separate steps for bending divider flaps or inserting divider partitions into the carrier.

Other objects and advantages of the invention will become apparent from the description of the preferred embodiment taken in conjunction with the accompanying drawings.

DESCRIPTION OF THE PREFERRED EMBODIMENT

Figure 1:
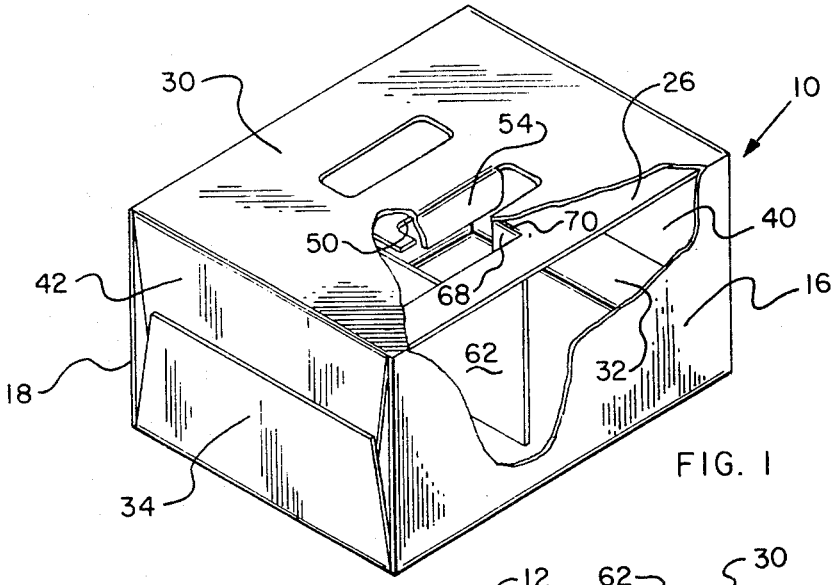
FIG. 1 is a perspective view, partially broken away, of a carrier in accordance with the invention.
Figure 6:
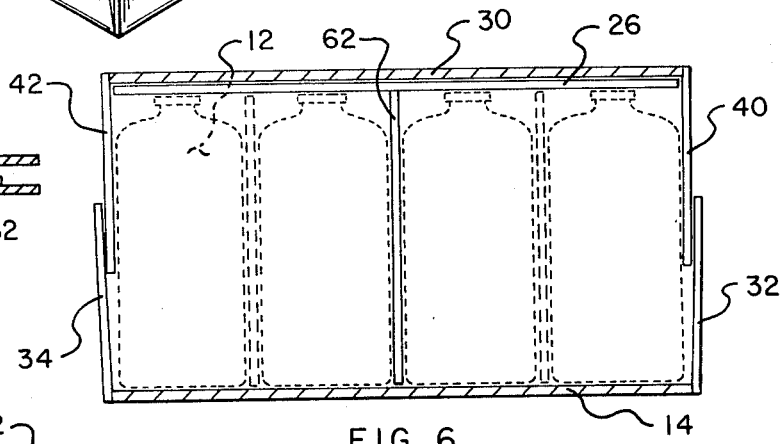
FIG. 6 is a front cross section view of the carrier of FIG. 1 with the assembled articles shown in phanton.
Figure 7:
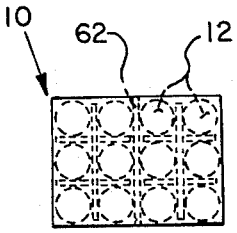
FIG. 7 is a top view of the carrier of FIG. 6.

There is illustrated in FIG. 1 a carton or carrier, indicated generally at 10, for containing a plurality of fragile articles, such as twelve bottles 12 (FIGS. 5, 6 and 7) during transportation and storage and the like. The bottles 12 are arranged in groups of six in separate parallel assembly lines wherein each group of six has two adjacent parallel rows of three adjacent bottles with the bottles in the two parallel rows being abreast. Conventional dividers 13 are positioned between the bottles in each group of six bottles in both assembly lines.

Figure 2:
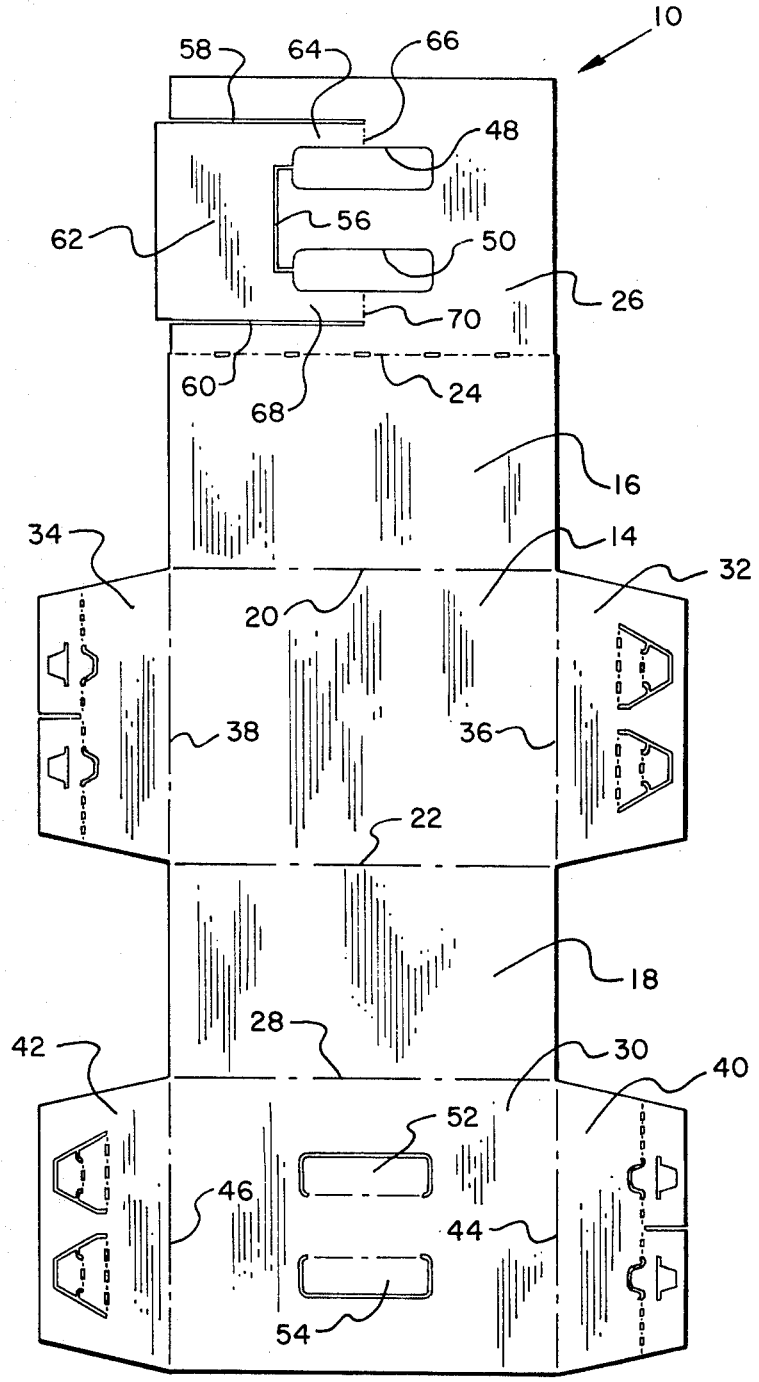
FIG. 2 is a plan view of a blank for forming the carrier of FIG. 1.

As shown in FIG. 2 the carrier 10 is formed from a integral blank of fiberboard or the like and has a bottom panel 14, a pair of side panels 16 and 18 having bottom edges joined at respective score lines 20 and 22 to opposite side edges of the bottom panel 14. The top edge of the side panel 16 is joined at a score line 24 to an inside top panel 26 while the top edge of the side panel 18 is joined at a score line 28 to a side edge of an exterior top panel 30. End flaps 32 and 34 are joined at respective score lines 36 and 38 to the opposite end edges of the bottom panel 14, and end flaps 40 and 42 are joined at respective score lines 44 and 46 to opposite end edges of the exterior top panel 30. Finger openings 48 and 50 are formed in the interior top panel 26, and bend-in finger tabs 52 and 54 are severed in the exterior top panel 30 for alignment with the openings 48 and 50 such that the tabs 52 and 54 may be bent through the openings 48 and 50 to form a handle portion for the carrier. The end flaps 32, 34, 40, and 42, may be provided with interlocking tab devices such that the flap 32 can be secured to the flap 40 and the flap 34 can be secured to the flap 42.

The interior top panel 26 has die cuts 56, 58, and 60 forming a partition 62. A strip-like upper side portion 64 of the partition 62 formed between the cut line 58 and the opening 48 is attached at the top edge thereof by a score line, hinge or hinge portion 66 to the rest of the interior top panel 26. A similar strip-like portion 68 on the opposite upper side of the partition 62 is attached at a score line, hinge, or hinge portion 70 to the interior top panel 26. The hinges 66 and 70 are aligned along a common axis which, is parallel to and centrally disposed between the opposite end edges of the interior top panel 26.

The hinges 66 and 70 are formed such that the partition 62 drops into a position extending sufficiently vertically to form separated spaces 72 and 74 (FIG. 5) extending from the partition 62 to respective opposite ends of the carrier 10 for receiving respective groups of six bottles. The strip-like portions 64 and 68 and thus the hinges 66 and 70 have widths which are substantially less than one-half the width of the partition 62, and preferrably the sum of the widths of the portions 64 and 68 is less than one-half the width of the partition 62 such that fiberboard portions forming the hinges 66 and 70 are sufficiently weak that the weight of the partition under the force of gravity will pivot the partition 62 about the hinges 66 and 70 to a downward extending position.

Figure 3:
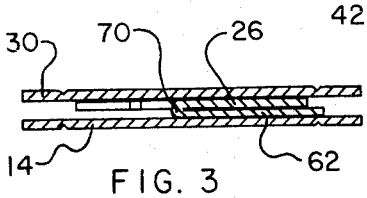
FIG. 3 is a front cross section view of the carrier of FIG. 1 in a folded position.

The material from which the carrier 10 is formed is selected to form hinges 66 and 70 which are partially resilient. The partition 62 is bent 180° about the hinges 66 and 70 against the inside surface of the interior top panel 26. Then the carrier 10 is folded into a flat condition as shown in FIG. 3 with the exterior top panel 30 overlapping and secured, such as by gluing or the like, to the interior top panel 26. The partial resilience of the hinges 66 and 70 is particularly selected to return the partition to the vertical position when the carrier 10 is unfolded from its flat condition.

Figure 5:
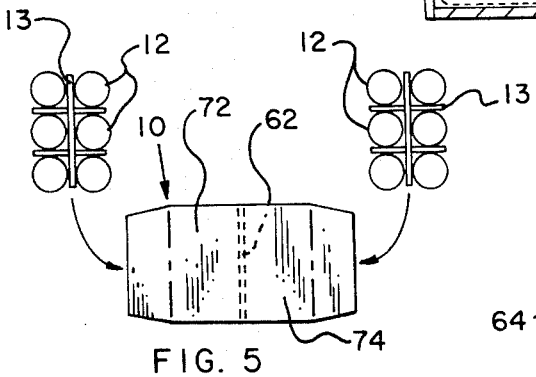
FIG. 5 is a plan view illustrating assembly of articles in the carrier of FIG. 4.
Figure 4:
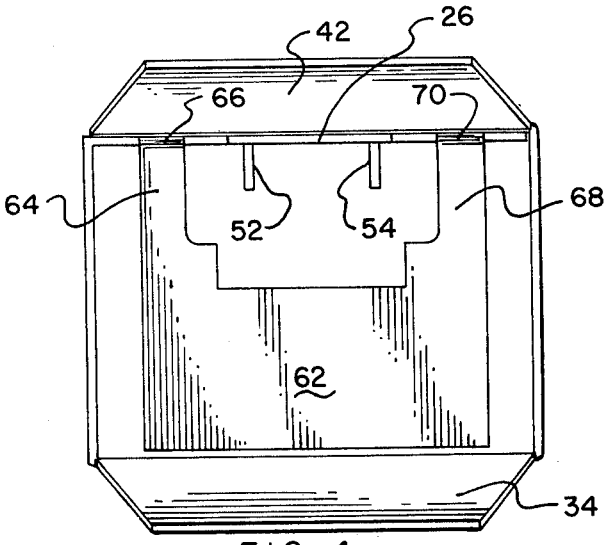
FIG. 4 is a side view of the carrier of FIG. 1 after being unfolded.

In use of the carrier 10, the carrier 10 is unfolded from its flat condition to the open condition as shown in FIGS. 4 and 5 with the end flaps 32, 34, 40 and 42 open. The weight of the partition 62 together with the resilient of the fiberboard at the hinges 66 and 70 causes the partition 62 to drop or pivot to a vertically extending position within the carrier forming a divider between portions 72 and 74 of the carrier 10. Then as illustrated in FIG. 5 a group of six bottles may be inserted sideways simultaneously into each open end of the carrier 10 such that the adjacent rows of bottles in respective groups of six bottles abut the partition 62 from opposite sides of the partition. The assembly of the bottles 12 into the carton is completed by securing end flap 32 to the end flap 40 and securing the end flap 34 to end flap 42 by use of the tab devices shown in FIG. 2 or by other suitable means such as gluing. The partition 62 protects the adjoining rows of bottles from breaking or the like during transportation or handling.

It is partically advantageous that the hinges 66 and 70 are formed such that the partition drops or pivots to a vertically extending position when the carrier 10 is unfolded from its flat position. This illuminates the necessity for providing a separate bending step after unfolding or the necessity of insertion of a separate partition between the groups of six bottles as they are inserted into the carrier 10.

The strip-like portions 64 and 68 having widths substantially less than one-half the width of the partition 62 provides an easy manufactured weakness in the hinges 66 and 70 which allows the force of gravity to aid in dropping the partition 62. Also the resilient nature of the hinges 66 and 70 together with the preformed 180° bend about the hinges 66 and 70 aids in pivoting the partition 62 downward. The particular combination of the narrow strip-like portions 64 and 68 and the partial resilience of the hinges 66 and 70 bent 180° results in the partition 26 pivoting substantially to a vertical position; thus other bending steps and separate insertion of partitions are eliminated.

Since many modifications, changes in detail and variations may be made to the present carrier, it is intended that all matter in the foregoing description and in the accompanying drawings be interrupted as illustrative and not in a limiting sense.

What is claimed is:

1. A method of assembling twelve fragile articles into a carrier comprising the steps of arranging the twelve articles into two separate groups of six articles in separate assembly lines wherein each group has two adjacent parallel rows of three articles with the articles in the parallel rows being abreast, positioning respective dividers between the articles of the two groups in the separate assembly lines, unfolding a carrier blank from a flat condition to an open condition, said carrier blank having an inside partition hinged to an inside top panel such that when the carrier is opened from a flat condition the partition drops under the force of gravity into a position extending sufficiently vertically to form separated portions within the carrier, inserting the separate groups of six articles with dividers sideways simultaneously into respective opposite open ends of the carrier such that adjacent rows of articles in the respective groups of six articles abut the opposite sides of the partition, and closing the open ends of the carrier to secure the articles in the carrier.

2. A method of assembling twelve fragile articles into a carrier as claimed in claim 1 wherein the articles are bottles.

* * * * *

UNITED STATES PATENT OFFICE
CERTIFICATE OF CORRECTION

PATENT NO. : U. S. 4,043,095

DATED : August 23, 1977

INVENTOR(S) : Earl J. Graser

It is certified that error appears in the above-identified patent and that said Letters Patent are hereby corrected as shown below:

Column 1, line 14, after "relates" add --to--.

Column 1, line 15, after "bottles in" delete --to--.

Column 1, line 39, delete "from" and insert in place thereof --form--.

Column 2, line 4, delete "phanton" and insert in place thereof --phantom--.

Column 3, lines 13 & 14 - delete "resilient" and insert in place thereof --resilience--.

Column 3, line 29, delete "partically" and insert in place thereof --particularly--.

Signed and Sealed this

*Third* Day of *October 1978*

[SEAL]

*Attest:*

RUTH C. MASON
*Attesting Officer*

DONALD W. BANNER
*Commissioner of Patents and Trademarks*